United States Patent [19]

Fulcher et al.

[11] Patent Number: 4,722,252

[45] Date of Patent: Feb. 2, 1988

[54] POWER DRIVEN WRENCH

[76] Inventors: William A. Fulcher, P.O. Box 657, Sandia Park, N. Mex. 87047; Gary L. Johnson, 12200 Ranchitos Dr. NE., Albuquerque, N. Mex. 87122

[21] Appl. No.: 20,774

[22] Filed: Mar. 2, 1987

[51] Int. Cl.[4] ..... B25B 13/46

[52] U.S. Cl. ..... 81/57.39; 81/63

[58] Field of Search ..... 81/57.39, 62, 60, 63; 384/611, 615; 403/327, 120, 145, 366

[56] References Cited

U.S. PATENT DOCUMENTS

| | | | |
|---|---|---|---|
| 935,482 | 9/1909 | Fresko | 81/57.39 |
| 2,264,012 | 11/1941 | Wasson | 81/57.39 |
| 2,491,624 | 12/1949 | Shaff | 81/57.39 |
| 2,578,686 | 12/1951 | Fish | 81/57.39 |
| 2,712,256 | 7/1955 | Fish | 81/57.39 |
| 2,719,446 | 8/1955 | Ford | 81/57.39 |
| 2,723,580 | 11/1955 | Brame | 81/57.39 |
| 3,270,595 | 9/1966 | Hall et al. | 81/57.39 |
| 3,529,498 | 9/1970 | Northcutt | 81/57.39 |
| 3,621,738 | 11/1971 | Northcutt | 81/57.39 |
| 4,346,630 | 8/1982 | Hanson | 81/57.39 |

FOREIGN PATENT DOCUMENTS

| | | | |
|---|---|---|---|
| 2263986 | 7/1974 | Fed. Rep. of Germany | 81/57.39 |

*Primary Examiner*—Frederick R. Schmidt
*Assistant Examiner*—Lawrence Cruz
*Attorney, Agent, or Firm*—William A. Eklund

[57] ABSTRACT

A power driven wrench includes a rotatable drive rotor journalled between fixed arms of a yoke affixed to one end of a wrench handle containing a motor. Disposed between the yoke arms is a ratchet head which is driven in reciprocal angular motion by the motor. The ratchet head is engaged with the drive rotor by means of a pawl in the ratchet head and a ratchet gear on the drive rotor. A direction switching lever within the ratchet head permits the direction of rotation of the drive rotor to be manually selected. The switching lever extends from the sides of the ratchet head, such that the direction of rotation of the wrench can be easily changed even if the wrench is inadvertently backed up against an immovable object while removing a nut or bolt. The location of the switching lever enables it be actuated with the same hand holding the wrench, and also results in the wrench having a thin profile which is useful in confined spaces. In the preferred embodiment the drive rotor includes a hexagonal bore and a smaller diameter throughbore, which enable the wrench to function as a power driven box end wrench when used with suitable tool inserts.

13 Claims, 10 Drawing Figures

POWER DRIVEN WRENCH

BACKGROUND OF THE INVENTION

The invention described and claimed herein is generally related to hand-held power tools. In particular, the present invention is related to hand-held power wrenches.

Power tools are virtually indispensable to auto mechanics and others in the field of auto repair and other medium duty mechanical applications. Speed of assembly and disassembly is an essential requirement that dictates the use of such power tools. However, the development of power tools, particularly power wrenches, has not kept pace with the development of automobile engine systems, which have evolved toward increasingly complex and closely packed engine systems. As a result of the increasing number of components in the modern automobile engine, disassembly and subsequent reassembly of the components which must be removed to gain access to a desired component has become an increasingly greater part of any repair or servicing of a vehicle. As a rule, commercially available power wrenches have remained the same size for approximately two decades, while engine compartments have become increasingly smaller and complex. Accordingly, while the need for power wrenches has steadily increased, their utility has to some extent declined because they are increasingly impractical to use in the tight spaces of a modern engine compartment.

Contemporary power wrenches are exemplified by the wrenches disclosed in U.S. Pat. No. 4,346,630 to Hanson, issued Aug. 31, 1982, and U.S. Pat. No. 3,529,498 to Northcutt, issued Sept. 22, 1970. Each of these patents discloses a power wrench having an angularly reciprocating, or oscillating, ratchet head that drives a rotatable square drive socket wrench stud. Standard wrench sockets are emplaced on the stud and driven either clockwise or counterclockwise, with the direction of rotation being selected by means of a bidirectional pawl and ratchet assembly.

A primary disadvantage of many of the commercially available power wrenches is that the direction changing mechanism is typically located on the back side of the wrench head, on the opposite side from the square drive stud where a socket is located. This results in the head of the wrench being relatively thick, thereby limiting its use in close quarters where there is little head room. Also, it can result in a serious problem if, while unscrewing a bolt or while removing a nut from a stud, the wrench head is inadvertently allowed to be driven backwards against a solid obstruction. In such an event the direction changing mechanism, being located on the back side of the wrench, becomes jammed against the obstruction. Because of the high torque applied by the drive motor, the wrench can suddenly become so jammed that the direction adjustment mechanism cannot be turned, or even reached, to reverse the direction of the wrench and thereby release the wrench from the jammed position. If the wrench is allowed to be jammed into such a position, it can be virtually impossible to remove the wrench without extensive and sometimes destructive disassembly of surrounding components, to remove the obstruction and thereby release the wrench.

Another disadvantage of commercially available power wrenches such as those described above follows from the fact that they typically include a standard square drive socket wrench stud, to which must be attached a standard closed end socket. Closed end sockets are those which are closed at one end and which therefore have a central bore of only a limited depth, typically less than about two inches at most. As a result, the commercially available power wrenches, with their associated closed end sockets, cannot be used to turn nuts on long studs or bolts. Such nuts must ordinarily be turned manually with hand-held open end or box end wrenches.

Another disadvantage of the previously known power wrenches is that they must typically be removed from a workpiece in order to actuate the direction changing mechanism, particularly when they are positioned on a nut or bolt that is hard to reach or when the wrench is in such a position that it can only be accessed with one hand. This difficulty occurs because the direction changing mechanism, when located on the back side of the wrench head, is difficult to reach with the same hand used to hold the wrench by its handle. At best the direction changing mechanism cannot be reached easily, and often the wrench cannot be released to access the direction changing mechanism, even momentarily, without the wrench falling off the workpiece.

Accordingly, it is an object and purpose of the present invention to provide an improved power driven wrench.

It is also an object of the present invention to provide an efficient and reliable power wrench that is a box end wrench.

It is another object of the present invention to provide a power driven box end wrench that is sufficiently compact to permit its use in tight spaces, and which is sufficiently thin in profile that it requires less head room than is required of previously known power wrenches.

It is yet another object of the present invention to provide a power driven wrench which has a direction changing mechanism that is not located on the back side of the wrench head.

Another object of the invention is to provide a power wrench that has a direction changing mechanism that can be manipulated with the same hand used to hold the wrench, without having to let go of the wrench.

Another object of the invention is to provide a power box end wrench which can be changed in direction without the necessity of removing the wrench from a workpiece.

SUMMARY OF THE INVENTION

The power driven wrench of the present invention includes a yoke affixed to the end of a tubular handle in which is located a suitable motor. The yoke includes two spaced apart arms, between which is contained an angularly reciprocating ratchet head and a substantially cylindrical, rotatable drive rotor. The drive rotor is effectively journalled between the opposing arms of the yoke and is rotatable in either a clockwise or counter clockwise direction with respect to the yoke. The ratchet head includes a bore which encircles the drive rotor and is driven in reciprocal angular motion about the drive rotor by means of a motor. The ratchet head includes a pawl which engages a ratchet gear integrally formed on the exterior surface of the drive rotor so as to permit the drive rotor to rotate only in one direction upon reciprocal motion of the ratchet head. A direction changing mechanism, also located in the ratchet head, permits selective positioning of the pawl so as to select the direction of rotation of the drive rotor. The positioning of the direction changing means in the ratchet head, as opposed to being in the drive rotor, is one of the essential differences between the wrench of the present invention and previously known wrenches, with certain resultant advantages. For example, only one hand is needed to hold the wrench and at the same time actuate the direction changing mechanism, which is a useful feature when working in confined spaces. Further, the wrench cannot be irreversiby jammed if it is inadvertently backed into an immobile obstruction during removal of a nut or stud.

The front end of the drive rotor includes a drive means that may take various forms which are standard in the industry, namely, square drive rotors, hex drive rotors and so on. However, in the preferred embodiment the drive rotor includes a hexagonal central bore which functions either as a fixed-size hexagonal socket, or to receive various inserts which have sockets corresponding in size to the standard socket wrench sizes, both metric and standard. Further, in the preferred embodiment there is a throughbore, of smaller diameter than the hexagonal bore, which extends from the bottom of the hexagonal bore and opens on the rear end of the drive rotor, such that the drive rotor essentially functions as a box end wrench socket. Further, each of the socket inserts also have bores extending their length, so that, regardless of the size of the nut to be turned, the wrench functions as a box end wrench that is able to accommodate nuts on long studs.

These and other aspects of the present invention are explained further below in the description of the preferred embodiment of the invention.

BRIEF DESCRIPTION OF THE DRAWINGS

The accompanying Figures are incorporated in and form a part of the present disclosure, and when taken with the following detailed description, serve to describe the preferred embodiment of the present invention. In the Figures.

DETAILED DESCRIPTION OF THE PREFERRED EMBODIMENT

Figure 1:
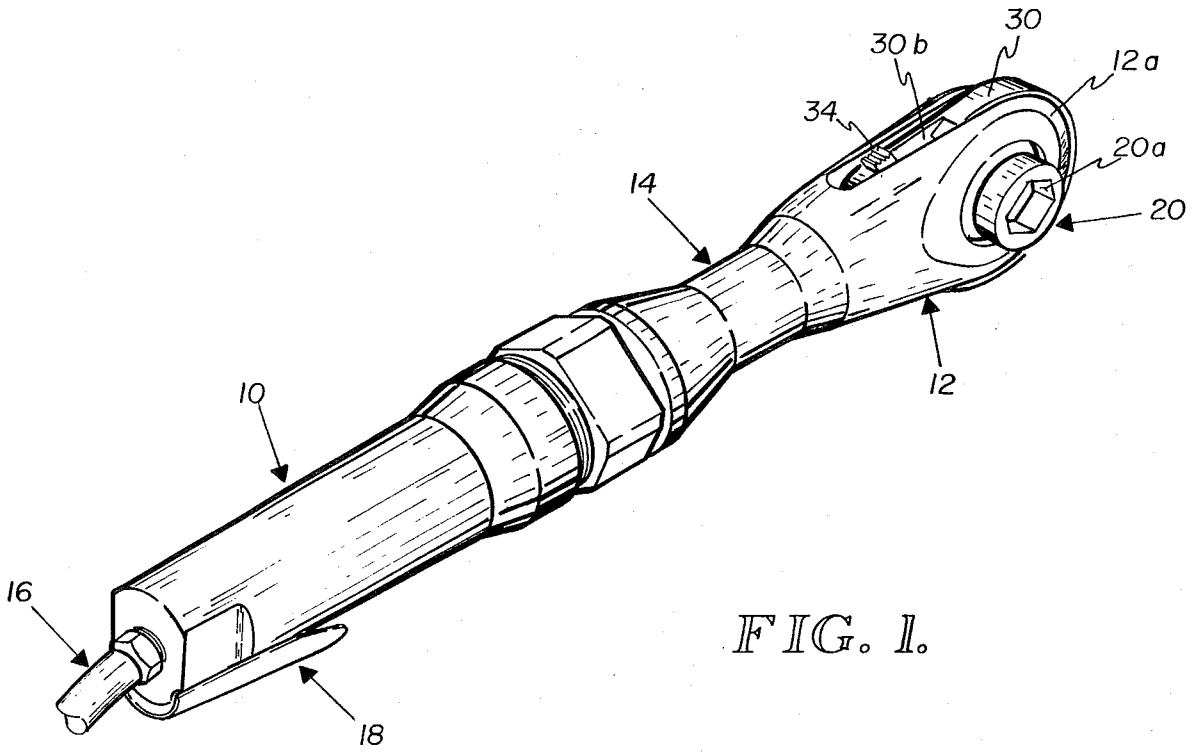
FIG. 1 is an isometric view of a preferred embodiment of the power wrench of the present invention.

Referring to FIGS. 1 through 7, the preferred embodiment of the power wrench of the present invention includes a generally cylindrical, tubular handle 10 which supports an oblong yoke 12 at the end of a cylindrical neck 14 between the handle 10 and the yoke 12. High pressure air is introduced into the wrench by means of a flexible pneumatic hose 16 which is connected to the end of the handle 10 opposite the yoke 12. Flow of air into the wrench is metered by means of a valve (not shown) which is actuated by an associated hand lever 18. The handle 10 contains a pneumatic motor which is not shown and which forms no part of the present invention.

The yoke 12 extends from the neck 14 and is preferably integrally formed therewith. The yoke 12 includes a front arm **12*a* and a rear arm 12*b*, which are generally parallel to one another and which are spaced apart uniformly to define a slot between them. The interior opposing faces of the arms 12*a* and 12*b* are planar and are parallel to one another. At the outer ends of the front and rear arms 12*a* and 12*b* of the yoke 12 there are two relatively large diameter, circular bores 12*c* and 12*d*, respectively, (FIG. 2**) which are coaxial with one another.

In the illustrated preferred embodiment the drive rotor consists of a box end drive socket 20 which is journalled for rotational motion in the bores **12*c* and 12*d* of the yoke arms 12*a* and 12*b*. The drive socket 20 includes a nominal $\frac{3}{4}$ inch hexagonal bore 20*a* that opens on the front end of the socket 20 and which extends approximately half way through the length of the socket 20. A smaller diameter cylindrical throughbore 20*b* (FIG. 5) drilled through the remainder of the socket 20, which provides clearance for long studs and bolt shafts. The $\frac{3}{4}$ inch hexagonal bore 20*a* permits the socket 20** itself to function as a $\frac{3}{4}$ inch box end wrench socket, and additionally functions to receive socket inserts having standard socket wrench diameters, as discussed further below.

It will be recognized that the box end drive socket 20 represents the preferred embodiment of the present invention. However, the box end socket 20 may be replaced with other forms of drive rotors, for example a solid square drive rotor such as is traditionally used in socket wrenches.

The socket 20 includes an integral external ratchet gear **20*c*, which defines the maximum diameter of the socket 20. At each end the socket 20 is stepped down in diameter from the ratchet gear 20*c* to cylindrical ends. The circular bore 12*d* in the rear arm 12*b* of the yoke 12 is sized in diameter just large enough to permit the socket 20 to be introduced through the bore 12*d* in the rear arm 12*b* and into its normal operating position within the yoke 12. The bore 12*c* in the front arm 12*a* of the yoke 12 includes an annular shoulder 12*e* which is sized to accommodate and journal the cylindrical front end of the socket 20. The front face of the larger diameter body of the socket 20, or that portion consisting of the ratchet gear 20*c*, abuts against the inside face of the shoulder 12*e*. The rear end of the socket 20 includes four axial bores 20*d* which contain coil springs 22 and ball bearings 24. The ball bearings 24 bear upon a thrust washer 26 that encircles the cylindrical rear end of the socket 20. The thrust washer 26 is retained in place by means of an expandible snap ring 28 that engages in an inwardly opening annular groove 12***f* (FIG. 5) formed in the inner surface of the bore 12*d* of the rear arm 12*b*. The snap ring 28 operates to retain the thrust washer 26 and the drive socket 20 in place, and the ball bearings 24 and associated springs 22 operate to maintain the drive socket 20 in a spring-biased position urged against the retaining shoulder 12*e* of the front yoke arm 12*a*.

An angularly reciprocatable ratchet head 30 is disposed in the slot between the front and rear arms 12*a* and 12*b* of the yoke 12, and encircles the drive socket 20. The ratchet head 30 is sized to fit closely between the arms 12*a* and 12*b* of the yoke 12. The ratchet head 30 is generally pear-shaped in plan view and rectangular in side view, and includes a circular bore 30*a* in the large end, which is ordinarily coaxial with the bores 12*c* and 12*d* in the yoke arms 12*a* and 12*b*, and which closely encircles the drive socket 20. In operation, the ratchet head 30 reciprocates, or oscillates, angularly about the common axis of the bores 12*c* and 12*d* in the yoke arms 12*a* and 12*b*, as well as about the drive socket 20, in a manner described further below. The reciprocating head 30 includes generally a ratchet pawl 32 and a switching lever 34 which together operate to control the direction of rotation of the drive socket 20 as a result of angular reciprocal motion of the ratchet head 30.

Referring to FIGS. 3, 4, 6 and 7, the ratchet head 30 includes an integral recess 30*b* in which the pawl 32 and the switching lever 34 are located. The pawl 32 and switching lever 34 are retained in the recess 30*b* of the ratchet head 30 by means of a planar retaining plate 36. The retaining plate 36 is fastened to the ratchet head 30 by means of four machine screws 38. The surfaces of the ratchet head 30 in the areas which are adjacent the recess 30*b* and also covered by the retaining plate 36 are milled out to a depth equal to the thickness of the retaining plate 36, so that the retaining plate 36 is inset flushly into the surface of the ratchet head 30 so as to form a continuous flush surface from one end of the ratchet head 30 to the other.

The switching lever 34 rotates about a pivot pin 40 which extends between and is affixed to the retaining plate 36 and the floor of the recess 20*b* of the ratchet head 30. The pawl 32 rotates about a second pivot pin 42, which likewise extends between the retaining plate 36 and the floor of the recess 30*b* of the ratchet head 20.

The recess 30*b* in which the pawl 32 and switching lever 34 are located extends the full width of the ratchet head 30, so as to form external openings in the sides of the ratchet head 30 when the retaining plate 36 is installed. The opposite ends of the switching lever 34 extend through these openings on each side of the ratchet head 30. The switching lever 34 is knurled at its opposite ends to facilitate manual switching of the position of the lever 34 between the two positions discussed below.

The switching lever 34 includes a spring-loaded pin 44 which extends radially with respect to the axis of pivot pin 40. In operation, the spring-loaded pin 44 is urged against a concave rear surface 32*a* (FIG. 7) of the pawl 32. The spring-loaded pin 44 causes the pawl 32 to rotate about its pivot pin 42, the direction of rotation being determined by the position of the switching lever 34 and associated pin 44. The two resting positions of the switching lever 34 and pawl 32 are shown in FIGS. 3 and 4.

The pawl 32 includes two sets of ratchet teeth 32*b* and 32*c*, one of which is meshed at any given time with the ratchet gear 20*c* that is integrally formed on the external cylindrical surface of the socket 20. The relative positions of the pawl 32 as they translate into the direction of rotation of the socket 20 are indicated in FIGS. 3 and 4, where the directional arrows shown on the drive socket 20 indicate the direction of rotation of the drive socket 20.

Figure 2:
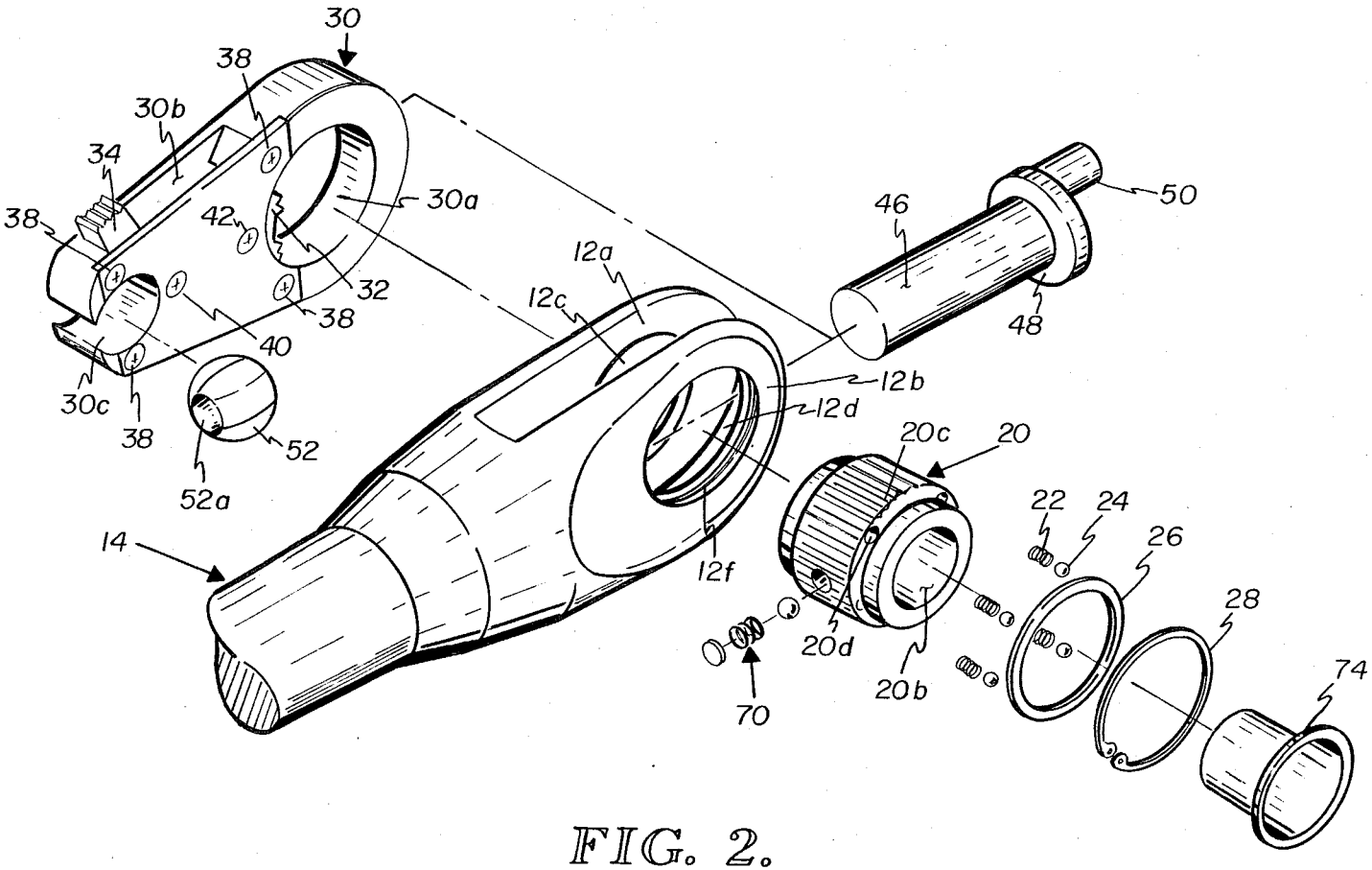
FIG. 2 is an enlarged and exploded isometric view of the rear side of the head of the power wrench shown in FIG. 1.
Figure 3:
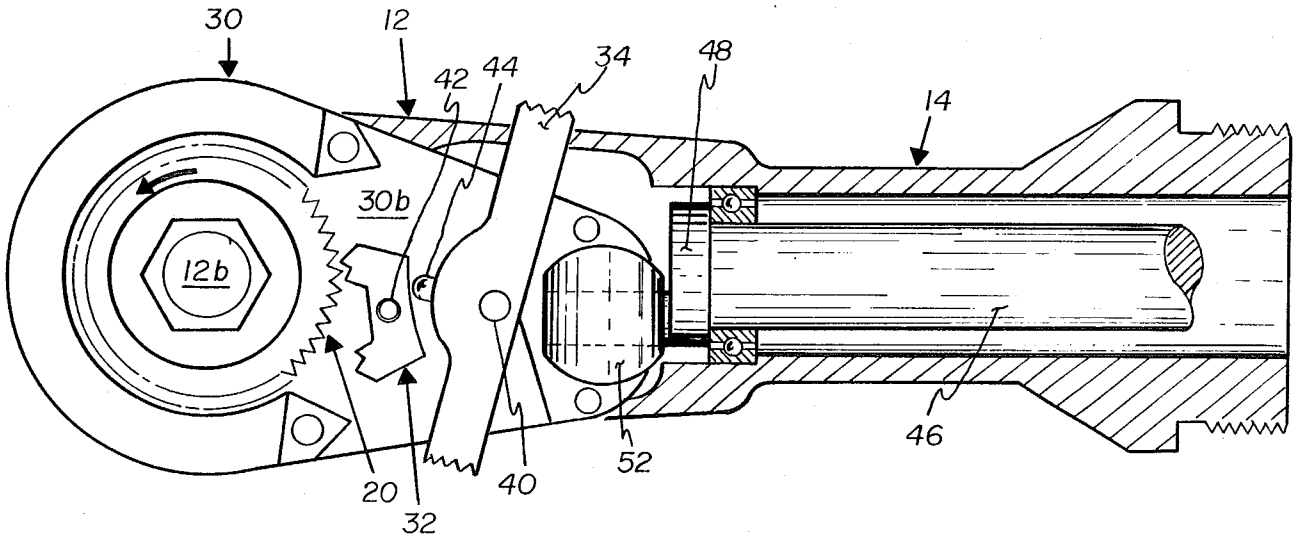
FIG. 3 is an enlarged front view in partial cross section of the head of the wrench shown in FIG. 1, with the direction changing mechanism set for counterclockwise rotation of the drive rotor.
Figure 4:
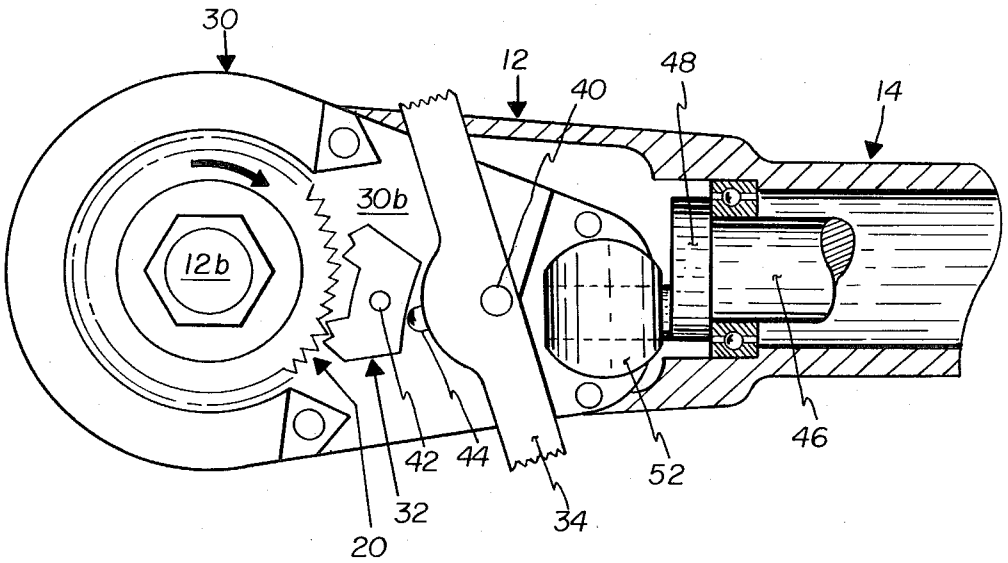
FIG. 4 is also an enlarged front view in partial cross section of the head of the wrench shown in FIG. 1, with the direction changing mechanism set for clockwise rotation of the drive rotor.

The ratchet head 30 is driven in reciprocating motion by means of an air driven motor (not shown) which causes a central drive shaft 46, shown in FIGS. 2, 3 and 4, for example, to rotate about its axis. The shaft 46 extends into the yoke 12 and includes at its end distant from the motor an integral cylindrical bushing 48 and a mounting stud 50 which extends from the bushing and is offset radially from the longitudinal axis of the drive shaft 46. A ball drive member 52 having a cylindrical bore 52*a* (FIG. 2) is mounted on the stud 50. The ball drive member 52 fits within a semicylindrical opening 30*c* formed in the small end of the ratchet head 30. Rotation of the drive shaft 46 causes the ball member 52 to travel through a circular path, which translates into reciprocal motion of the small end of the ratchet head 30. Reciprocal motion of the small end of the ratchet head 30 results in angular reciprocal motion, or oscillation, of the ratchet head 30 about the socket ratchet gear 20*c*. Depending on the position of the pawl 32, the socket 20 is driven in a clockwise or counterclockwise direction, as required, and as shown in FIGS. 3 and 4.

It will be noted that the ratchet head 30 is symmetrical and can be placed within the yoke such that the retaining plate 36 faces either toward the back side of the wrench, as in FIG. 2, or toward the front side of the wrench as is illustrated in FIGS. 3 and 4.

Figure 6:
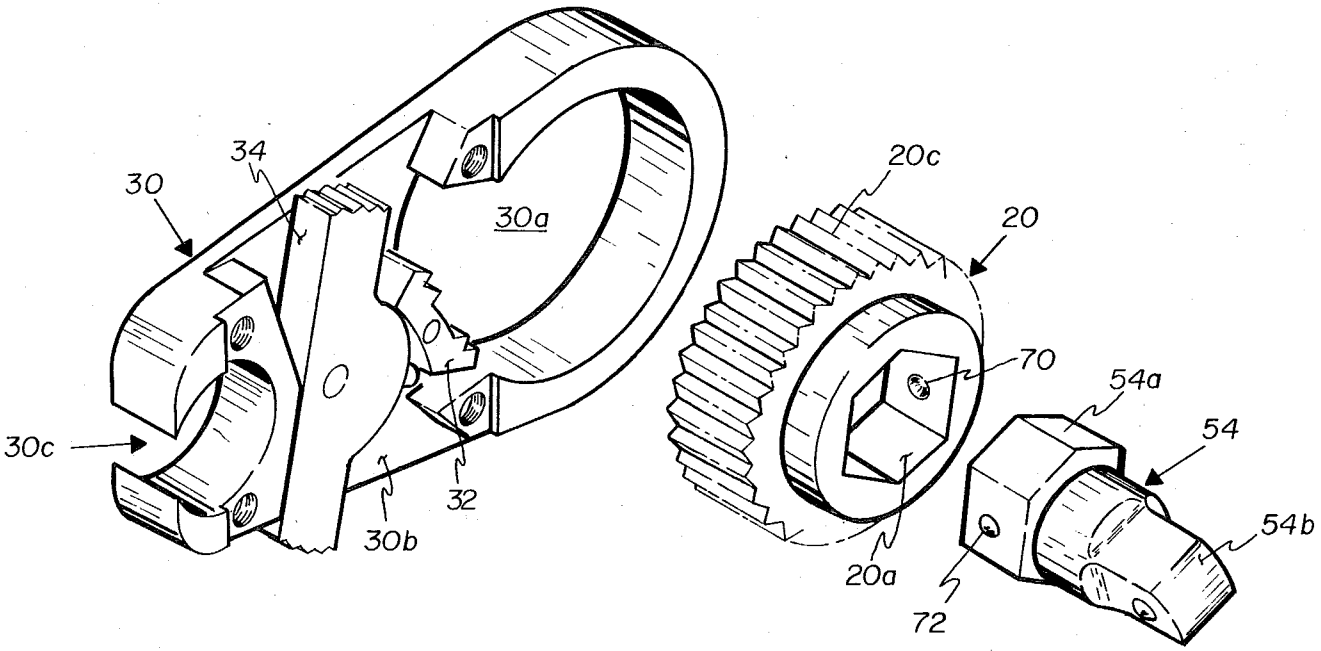
FIG. 6 is an isometric view of the ratchet head, drive rotor and a square drive insert for the power wrench shown in FIG. 1.
Figure 7:
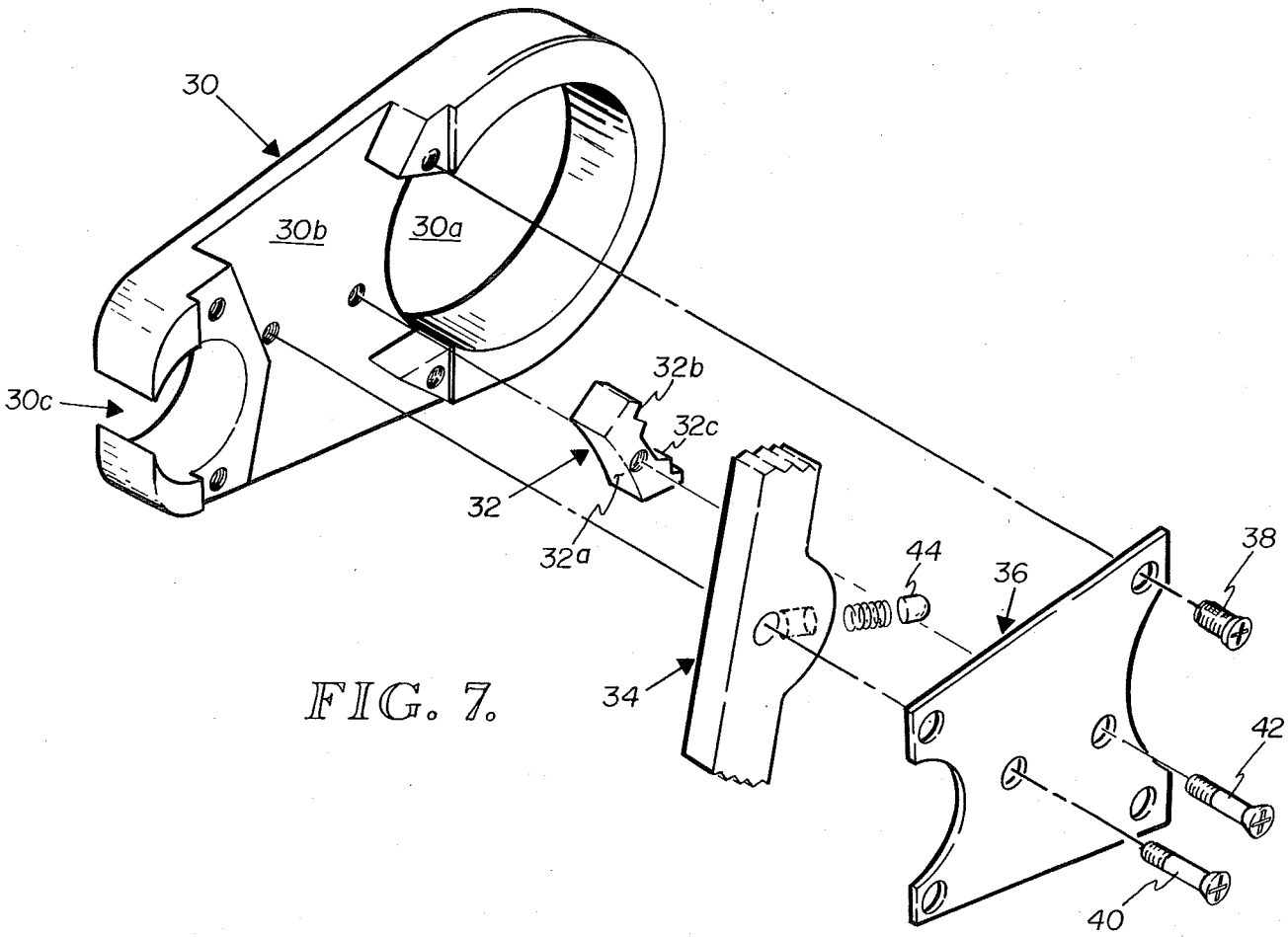
FIG. 7 is an enlarged and exploded isometric view of the ratchet head of the power wrench shown in FIG. 1.
Figure 8:
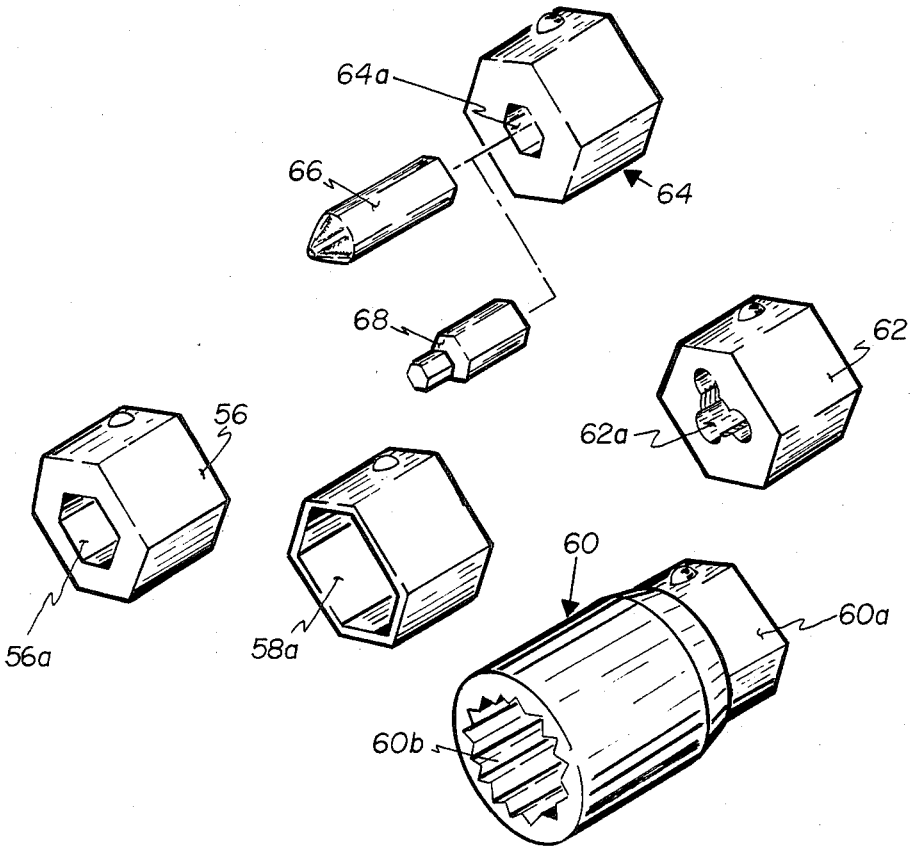
FIG. 8 illustrates several inserts for the power wrench illustrated in FIGS. 1 through 7.

Various inserts are insertable in the $\frac{3}{4}$ inch hexagonal bore 20*a* of the drive socket 20, as shown in FIGS. 6 and 8. Of course the wrench itself, with only the socket 20 and without any inserts, can be used alone as a $\frac{3}{4}$ inch socket wrench. All inserts will have an external $\frac{3}{4}$ inch hexagonal shape, so as to fit flushly into the hexagonal bore 20*a* of socket 20. Inserts for use as sockets will have internal hexagonal bores that are sized in various metric and standard sizes smaller than $\frac{3}{4}$ inch, in either 6, 8 or 12-point openings. The hexagonal bore in each insert preferably extends only partially through the insert, with a smaller diameter cylindrical throughbore extending the remainer of the way through the insert. This allows the wrench to be placed over long studs, but at the same time prevents the nuts or bolt heads from passing entirely through the wrench.

FIG. 6 illustrates an insert 54 which includes a $\frac{3}{4}$ inch hexagonal stud 54*a*, for insertion in the drive socket 20, and a conventional $\frac{1}{2}$ inch square drive stud 54*b*, which enables the wrench to accept conventional sockets.

FIG. 8 illustrates two hexagonal sockets 56 and 58 which include hexagonal bores 56*a* and 58*a*, respectively, which are of different sizes somewhat smaller than nominal $\frac{3}{4}$ inch hegaonal exterior size of the sockets 56 and 58.

Also illustrated in FIG. 8 is a deep well insert 60 which has a $\frac{3}{4}$ inch hexagonal stud 60*a* for insertion in the drive socket 20 of the wrench, and which has a 12-point socket bore 60*b* which is larger than $\frac{3}{4}$ inch. Inserts of this type enable the wrench to drive nuts and bolts larger than the nominal $\frac{3}{4}$ inch size of the drive socket 20.

FIG. 8 also illustrates a hexagonal insert 62 which includes a thread die 62*a* for use in cleaning dirty bolt threads or rethreading damaged bolt threads.

FIG. 8 also illustrates a general purpose hexagonal insert 64 which includes a small diameter hexagonal bore 64*a* that is designed to accept, in turn, even smaller diameter hexagonal inserts. Illustrated examples of such smaller diameter inserts include a Phillips head screwdriver bit 66 and an Allen wrench bit 68.

All of the above inserts are retained in the socket 20 by means of a friction ball bearing and spring assembly 70 (FIGS. 5 and 6), which opens onto the inside surface of the ¾ hexagonal bore 20*a* of the drive socket 20. The inserts each include concave detents, for example the detent 72 illustrated on the insert 54 of FIG. 6, which receive the ball of the ball bearing and spring assembly 70.

Figure 5:
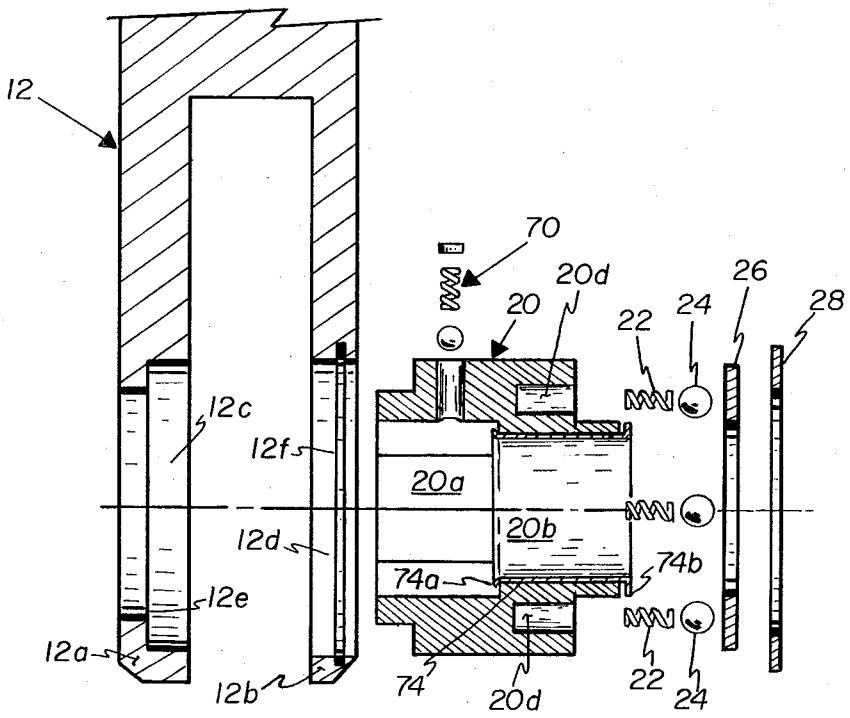
FIG. 5 is an enlarged and exploded side view of the head of the wrench shown in FIG. 1, without the ratchet head.

Some inserts, particularly those such as inserts 56 and 58 of FIG. 8, may be hard to grasp and remove with the fingers once the inserts are lodged in the bore 20*a* of the drive socket 20. Accordingly, there is provided an optional tubular sleeve 74, illustrated in FIGS. 2 and 5, which can be used to drive an insert out of the socket 20. The sleeve 74 is sized to fit through the cylindrical throughbore 20*b* of the socket 20, and be mushroomed outwardly at its inner end 74*a*, as illustrated in FIG. 5, so to as to be permanently emplaced in the socket 20. The outer end 74*b* of the sleeve 74 also mushrooms out, and the sleeve 74 is lightly longer than the length of the throughbore 20*b* so that it extends a small distance from the rear of the wrench when a tool insert is installed. To remove an insert lodged in the socket 20, the sleeve is tapped with the palm of the hand at the back of the wrench to drive an insert out of the front of the hexagonal socket bore 20*a*.

Although the preferred embodiment has been described above as having a ¾ inch socket 20, which is considered the optimum maximum size for most automotive applications, it will be apparent that where larger sockets are required the entire wrench may be scaled up in size.

It will be noted that one primary advantage of the invention just described is the location of the direction switching lever on the opposite sides of the ratchet head. This precludes the possibility of the direction changing mechanism becoming jammed or inaccessible due the wrench being backed up against an immobile object. The switching lever is virtually always accessible, and, further, it can be operated from either side of the wrench, thus making it always possible to reverse the direction of the wrench. Moreover, it is operable with the same hand holding the handle of the wrench, since the lever is positioned close to the handle of the wrench.

It will be appreciated that the wrench of the present invention has a profile that is substantially narrower than wrenches known in the prior art, thus requiring less head room for normal operation, and that this result follows from two aspects of the present invention. First, the direction changing mechanism is located in the ratchet head and is accessed from the sides of the wrench, rather than from the back of the wrench. Secondly, the wrench of the present invention includes a hexagonal socket drive, and various inserts to accommodate nuts of different sizes, as opposed to a standard square drive socket wrench stud that must be coupled to a standard closed end socket. These two features operate in combination to give a wrench head that is thinner and requires less head room than previouly available power driven wrenches.

Figure 9:
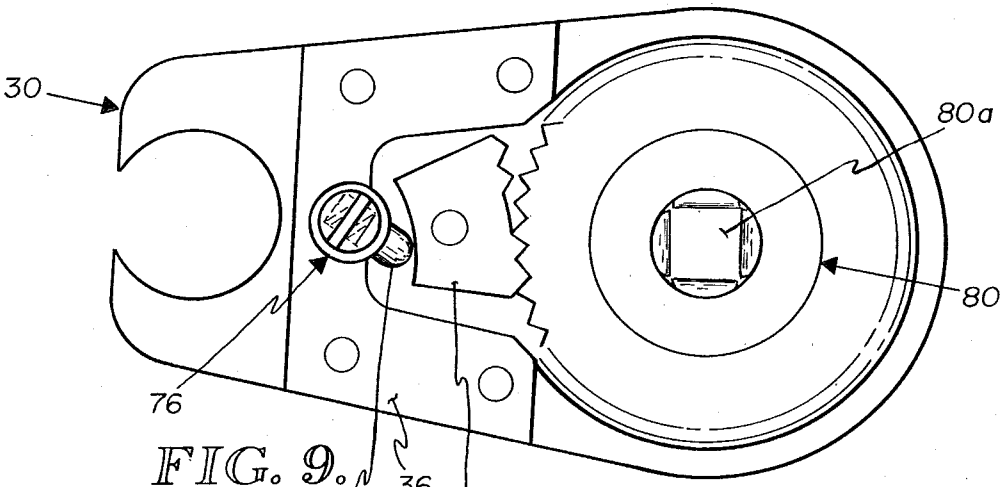
FIG. 9 is a front view of the ratchet head and drive rotor of an alternative embodiment of the power driven wrench of the present invention.
Figure 10:
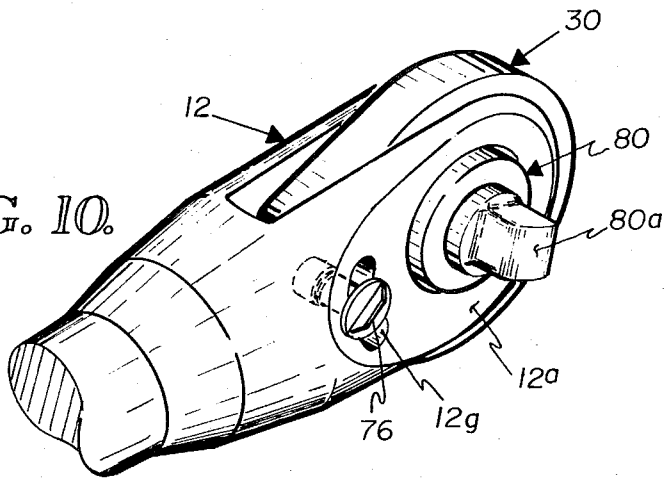
FIG. 10 is an isometric view of the head of the power driven wrench of the alternative embodiment partially illustrated in FIG. 9.

FIGS. 9 and 10 illustrate an alternative embodiment of the invention, which differs from the preferred embodiment described above in two respects. The ratchet head 30, as in the preferred embodiment, includes a pawl 32 and retaining plate 36. This alternative embodiment differs from the preferred embodiment in the first respect in that the direction changing mechanism includes a rotatable thumb knob 76 which extends through the front yoke arm 12*a* of the wrench, instead of the switching lever 34 of the preferred embodiment. The shaft of the thumb knob 76 includes a radially extending, spring-loaded pin 78, which positions the pawl 32 in the same manner as the pin 44 described above for the switching lever 34. The position of the pawl 32 is selected by turning the thumb knob 76. In this alternative embodiment, there is provided in the front yoke arm 12*a* a curved slot 12*g* to accommodate the relative reciprocal motion of the thumb knob 76 with respect to the fixed yoke 12 during reciprocating motion of the ratchet head 30.

FIGS. 9 and 10 also illustrate the alternative version of the drive rotor adverted to above. Instead of a box end drive socket 20, as in the preferred embodiment shown in FIGS. 1 through 7, the wrench of FIGS. 9 and 10 includes a solid drive rotor 80 that has a standard square drive stud 80*a* extending from the front end of the rotor 80. The square drive stud 80*a* is sized to receive standard sockets such as are commonly used with commercially available socket wrench kits.

The foregoing detailed descriptions and illustrations of the preferred and alternative embodiments of the invention are presented for the purpose of enabling a person of ordinary skill in the art to make and use the invention. The foregoing detailed descriptions and illustrations of the preferred and alternative embodiments are not intended limit the scope of the patent protection being sought, and various modifications, alterations and substitutions which will be apparent to one of ordinary skill in the art may be made without departing from the essential invention. Accordingly, the scope of the invention is defined by the following claims.

The invention claimed is:

1. A power wrench comprising:

a handle containing therein motor means operable to rotate a drive shaft extending from a first end of said handle;

a yoke affixed to said first end of said handle, said yoke having front and rear arms, each of said arms having a bore therethrough, said bores being coaxial with one another, said drive shaft extending into said yoke and terminating in a ball drive member mounted on a radially offset drive stud affixed to said drive shaft, whereby rotation of said drive shaft results in said ball drive member traveling through a circular path;

a drive rotor journalled for rotational motion in said bores of said arms of said yoke, said drive rotor having a substantially cylindrical body and having a ratchet gear formed on the exterior cylindrical surface of said body, said drive rotor having a first end and a second end, said first end of said drive rotor having drive means for engaging tools adapted to engage said drive means; and a reciprocatable ratchet head disposed between said arms of said yoke, said ratchet head being generally oblong in shape and having first and second ends, said first end of said ratchet head including a circular bore that encircles said ratchet gear of said drive rotor, said second end of said ratchet head including a semicircular opening in which is positioned said ball drive member, such that rotation of said drive shaft and said ball drive member drive said second end of said ratchet head in reciprocal oscillatory motion and thereby also drive said first end of said ratchet head in reciprocal angular motion about said drive rotor, said ratchet head further including selectively positionable and bidirectional pawl means for engaging said ratchet gear of said drive rotor so as to drive said drive rotor in a desired rotational direction, and said ratchet head further including direction changing means for manually selecting the position of said pawl means.

2. The power driven wrench defined in claim 1 wherein said drive means of said drive rotor comprises a hexagonal bore formed in said drive rotor and opening onto said first end of said drive rotor, whereby inserts having various types of wrench sockets and tool bits may be inserted into said hexagonal bore of said drive rotor.

3. The power wrench defined in claim 2 wherein said drive rotor further includes a throughbore extending from said hexagonal bore to and opening onto said second end of said drive rotor, said throughbore being of smaller diameter than the diameter of said hexagonal bore, whereby said drive rotor is operable as a box end wrench socket, thereby enabling said wrench to be used as a power driven box end wrench.

4. The power driven wrench defined in claim 3 further comprising a tubular sleeve positioned in said throughbore, said sleeve being mushroomed at each end to retain said sleeve in said throughbore, said sleeve having a length slightly greater than the length of said throughbore, whereby said sleeve is operable to remove tool inserts inserted in and lodged in said hexagonal bore of said drive rotor.

5. The power driven wrench defined in claim 1 wherein said drive means of said drive rotor comprises a square drive stud.

6. The power driven wrench defined in claim 1 wherein said drive rotor is retained in said yoke by means of a thrust washer and a snap ring which engages an inwardly opening groove formed in said bore of said rear yoke arm, said drive rotor further including a plurality of small, rearwardly opening bores positioned to open onto said thrust washer, and said drive rotor further including coil springs and ball bearings positioned in said rearwardly opening bores, whereby said ball bearings are urged against said thrust washer by means of said coil springs to thereby resiliently urge said drive rotor toward said front arm of said yoke.

7. The power driven wrench defined in claim 1 wherein said ratchet head includes a central recess covered by a removable retaining plate, and wherein said pawl means and said direction changing means are located within said recess.

8. The power driven wrench defined in claim 7 wherein said pawl means includes first and second sets of ratchet teeth, each operable to engage said ratchet gear of said drive rotor, and wherein said pawl means is pivotably mounted on a pivot pin journalled at its opposite ends in said ratchet head and said removable retaining plate.

9. The power driven wrench defined in claim 8 wherein said direction changing means comprises a switching lever pivotably mounted on a pivot pin extending between and journalled at its opposite ends in said ratchet head and said retaining plate, said switching lever being engaged with said pawl means to selectively engage one of said sets of ratchet teeth with said ratchet gear of said socket means.

10. The power driven wrench defined in claim 9 wherein said recess in said ratchet head extends the full width of said ratchet head, so that there are openings in the opposite sides of said ratchet head when said retaining plate is attached to said ratchet head, and wherein said switching lever includes opposite ends which extend from said openings on the opposite sides of said ratchet head, whereby said switching lever can be manually actuated from either side of said ratchet head.

11. The power driven wrench defined in claim 10 wherein said switching lever includes a spring loaded pin which extends radially with respect to the axis of rotation of said pivot pin on which said switching lever is mounted, and wherein said pawl means includes a concave bearing surface extending substantially parallel to the axis of rotation of said pivotably mounted pawl means and offset radially from said axis of rotation of said pawl means, said spring loaded pin of said switching lever abuting said bearing surface of said pawl means, whereby said spring loaded pin functions simultaneously to maintain said pawl means in a position manually selected by operation of said switching lever and corresponding to a desired rotational direction of said drive rotor, and to maintain said pawl means urged in resilient engagement with said ratchet gear of said drive rotor so as to operate in its ordinary manner as a pawl to restrict the rotation of said drive rotor to a single direction.

12. The power driven wrench defined in claim 8 wherein said direction changing means comprises a manually rotatable thumb knob pivotably mounted within said ratchet head, said thumb knob being engaged with said pawl means to selectively engage one of said sets of ratchet teeth of said pawl means with said ratchet gear of said drive rotor, and wherein said front arm of said yoke includes a slot through which said thumb knob extends forwardly from said ratchet head.

13. The power driven wrench defined in claim 12 wherein said thumb knob includes a spring loaded pin which extends radially with respect to the axis of rotation of said thumb knob, and wherein said pawl means includes a concave bearing surface extending substantially parallel to the axis of rotation of said thumb knob and offset radially from said axis of rotation of said thumb knob, said spring loaded pin of said thumb knob abuting said bearing surface of said pawl means, whereby said spring loaded pin functions simultaneously to maintain said pawl means in a position selected by manual rotation of said thumb knob and corresponding to a desired rotational direction of said drive rotor, and to maintain said pawl means urged in resilient engagement with said ratchet gear of said drive rotor so as to operate in its ordinary manner as a pawl to restrict the rotation of said drive rotor to a single direction.

* * * * *